US009453398B1

(12) United States Patent
Zhang et al.

(10) Patent No.: US 9,453,398 B1
(45) Date of Patent: Sep. 27, 2016

(54) SELF-STABILIZING GAS LIFT VALVE

(71) Applicant: The University of Tulsa, Tulsa, OK (US)

(72) Inventors: Hong-Quan Zhang, Tulsa, OK (US); Jose Luis Arellano, Houston, TX (US)

(73) Assignee: The University of Tulsa, Tulsa, OK (US)

( * ) Notice: Subject to any disclaimer, the term of this patent is extended or adjusted under 35 U.S.C. 154(b) by 156 days.

(21) Appl. No.: 14/322,483

(22) Filed: Jul. 2, 2014

Related U.S. Application Data

(60) Provisional application No. 61/841,979, filed on Jul. 2, 2013.

(51) Int. Cl.
*E21B 43/12* (2006.01)

(52) U.S. Cl.
CPC ..... *E21B 43/123* (2013.01); *Y10T 137/2934* (2015.04)

(58) Field of Classification Search
CPC ..... E21B 43/123; Y10T 137/2934
See application file for complete search history.

(56) References Cited

U.S. PATENT DOCUMENTS 2,144,144 A * 1/1939 Crickmer ..... E21B 43/123 137/155
2,241,656 A * 5/1941 Crickmer ..... E21B 43/123 417/115
2,305,250 A * 12/1942 Garrett ..... E21B 43/123 417/117
2,673,568 A * 3/1954 Buffington ..... E21B 43/123 137/155
2,681,014 A * 6/1954 Bryan ..... E21B 43/123 137/155
3,101,735 A * 8/1963 Brown ..... E21B 43/123 137/155
3,654,949 A * 4/1972 McMurry ..... E21B 43/123 137/155
4,721,284 A * 1/1988 Bankard ..... F16K 1/54 251/122
5,176,164 A * 1/1993 Boyle ..... E21B 34/06 137/155
6,932,581 B2 8/2005 Messick
7,370,706 B2 5/2008 Becker et al.
7,546,880 B2 6/2009 Zhang et al.
7,784,553 B2 * 8/2010 Moreno ..... E21B 43/123 166/332.4
8,225,874 B2 * 7/2012 Messick ..... E21B 43/123 166/325
2007/0215358 A1 * 9/2007 Messick ..... E21B 43/123 166/372
2010/0288502 A1 * 11/2010 Stokka ..... E21B 43/123 166/321
2012/0186662 A1 * 7/2012 De Almeida ..... E21B 43/123 137/155
2013/0032226 A1 * 2/2013 Salihbegovic ..... E21B 43/123 137/511
2013/0094975 A1 * 4/2013 Stokka ..... F04F 5/00 417/54
2014/0076579 A1 * 3/2014 Salihbegovic ..... E21B 43/123 166/374

* cited by examiner

*Primary Examiner* — Shane Bomar
(74) *Attorney, Agent, or Firm* — Head, Johnson & Kachigian, P.C.

(57) ABSTRACT

A self-stabilizing gas lift valve apparatus for oil and gas production. The apparatus includes a valve body having at least one gas inlet in communication with an elongated gas chamber in the valve body. An impingement disk is moveable in the elongated gas chamber. A conical plug extends from the impingement disk with the conical plug having a valve plug extending axially therefrom. A conical cup terminates in a valve seat wherein the conical cup receives the conical plug therein. A valve closure force mechanism urges the valve plug toward the valve seat. Gas injected through the gas inlet provides a force upon the impingement disk to overcome the force of the valve closure force mechanism in order to open the valve plug. When the gas injected exceeds a predetermined force, the impingent disk is moved and a conical space between the conical plug and the conical cup is reduced.

14 Claims, 11 Drawing Sheets

SELF-STABILIZING GAS LIFT VALVE

CROSS-REFERENCE TO RELATED APPLICATIONS

This application claims priority to and the benefit of U.S. Provisional Patent Application Ser. No. 61/841,979, filed Jul. 2, 2013, which is herein incorporated in its entirety by reference.

BACKGROUND OF THE INVENTION

1. Field of the Invention

The present invention relates to an apparatus and a process for regulating gas injection for artificial lift of fluids in oil and gas wells.

2. Prior Art

Gas lift valves are utilized in connection with artificial lift procedures in downhole oil and gas wells. Pressurized gas, such as natural gas, is injected from the surface into the annulus formed by downhole production tubing and an outer casing. The well fluid inside the production tubing exerts hydrostatic pressure that increases with well depth. The injection of gas reduces the weight of the hydrostatic column, thus reducing the back pressure on the formation by reducing density and allowing reservoir pressure to push a mixture of produced fluids and gas up to the surface. In addition, as the gas rises, the gas bubbles help force or push the produced fluids, such as oil, ahead of or with them. The pressurized gas may be injected at a single point downhole below the fluid level or may be supplemented by multi-point injection.

The so-called lift gas is injected downhole into the production tubing to the produced fluid stream through one or more valves that are set at specified depths. The lift gas and the formation fluids are thereby forced and produced to the surface. At the surface, the injected gas and the liquids are thereafter separated. The gas may then be treated and either sent to compression or sent for sales.

It is desirable to stabilize the tubing pressure downhole within a certain range based on the gas supply pressure and based on the production rate.

The present invention automatically provides an apparatus and a process to regulate the gas injection rate so that the tubing pressure is stabilized within a certain range based on the gas supply pressure and based on the production rate.

SUMMARY OF THE INVENTION

The present invention is directed to a self-stabilizing and self-regulating gas lift valve apparatus and a method for artificial lift in oil and gas production.

The gas lift valve apparatus includes an elongated tubular body having a top and a base which form an elongated gas chamber within the tubular body. At least one gas inlet port through the tubular body permits passage of injected gas into the elongated gas chamber. A generally flat circular impingement disk is moveable within the elongated gas chamber.

Extending from the lower side or face of the impingement disk is a conical plug which is coaxial with the disk.

Extending axially from the conical plug is a central shaft which is connected to a valve plug.

On the opposed side of the valve plug is a valve closure force mechanism. One or more outlet passages permit passage of pressurized gas from the elongated gas chamber through the base of the gas valve apparatus and thereafter into the production tubing.

A conical cup is axially aligned within the tubular body. Extending from the conical cup is a valve seat. The valve plug is urged toward the valve seat by the force closure mechanism.

When gas pressure at the outlets is greater than the pressure at the inlet, the valve plug is urged upward by force of the compression spring and the opening between the valve plug and valve seat is closed.

When pressurized gas is introduced through the inlet or inlets, the kinetic energy from the injected gas is converted to downward force on the impingement disk. The force of the pressurized gas on the impingement disk forces the conical plug and valve plug downward so that the valve plug is moved away from the valve seat, providing an opening or passageway for gas through the outlets and into the production tubing.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
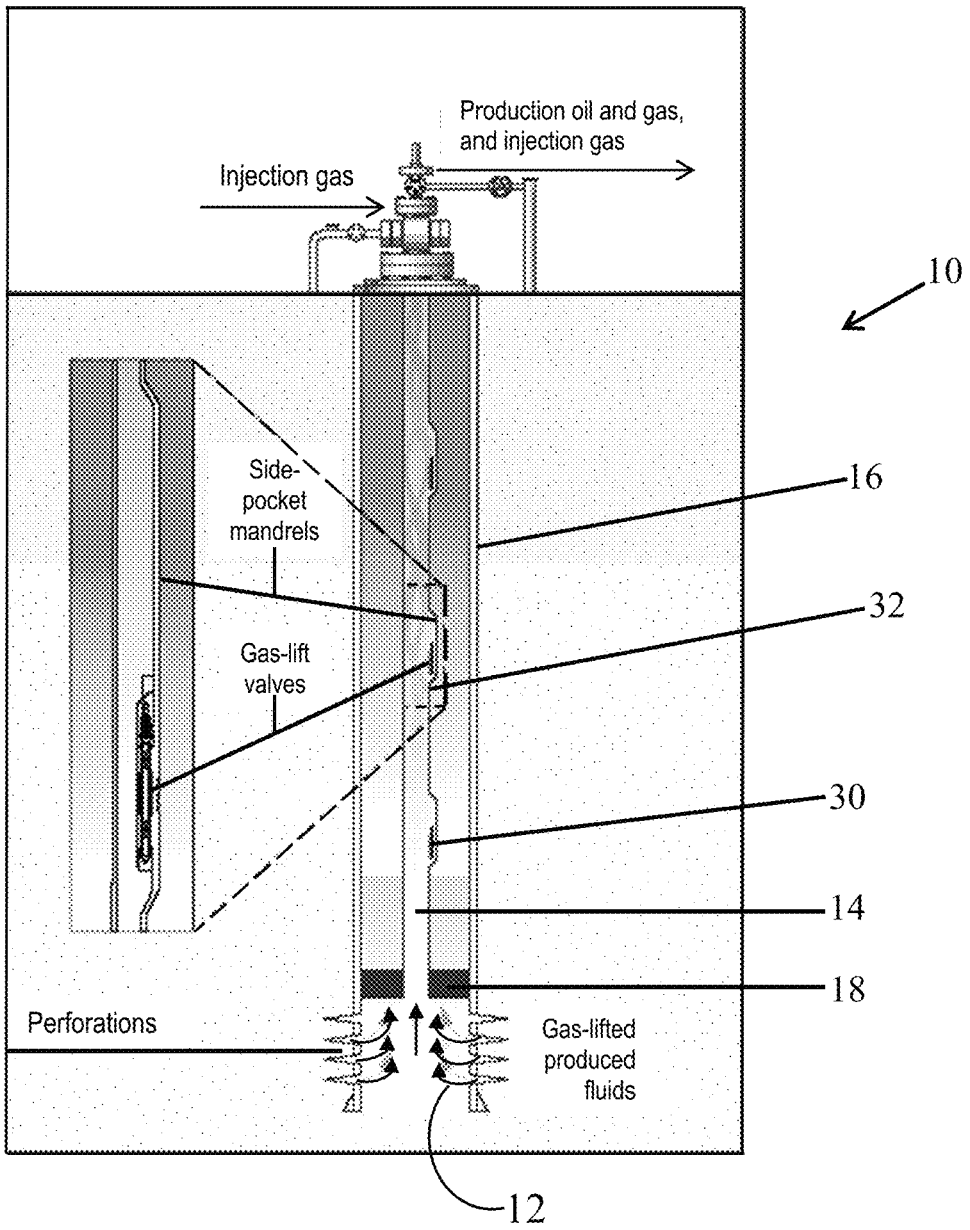
FIG. 1 is a simplified diagrammatic view of the various arrangement and equipment for production of fluids from an oil and/or gas well utilizing artificial lift techniques.

Referring to the drawings in detail, FIG. 1 illustrates a simplified diagrammatic view of an arrangement of equipment for production of fluids from an oil and/or a gas well 10. Subterranean fluids, illustrated by arrows 12, are drawn up through a production tubing or tubing string 14. The tubing string 14 is axially centered within an outer, larger diameter casing 16.

Downhole packing 18 creates a seal between the outer casing 16 and the inner production tubing or tubing string 14.

Pressurized gas may be injected from the surface into the annulus between the production tubing string 14 and the casing 16. Natural gas or other gases may be utilized. The pressurized gas will be introduced into the tubing string 14 through one or more gas lift valve apparatus 30 to be described in detail herein.

The gas lift valve apparatus 30 may be mounted by a mandrel 32 or by other mechanisms to the tubing string 14.

Figure 2:
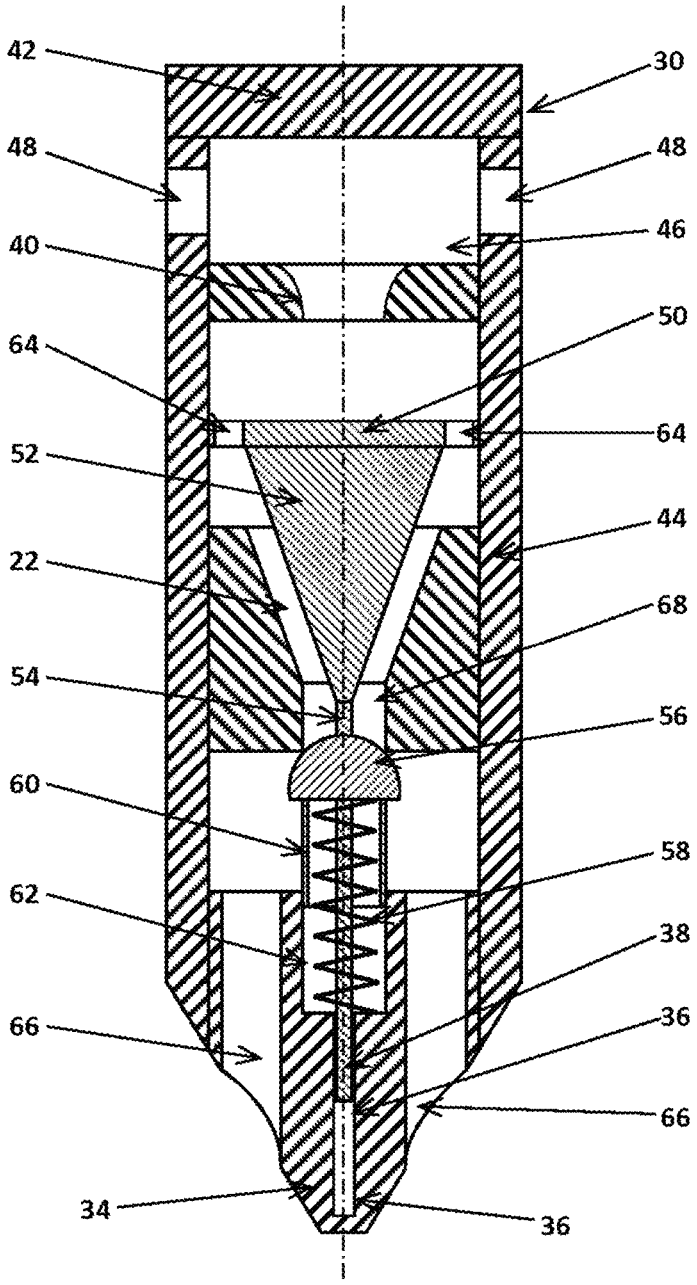
FIG. 2 illustrates a cross-sectional view of a first preferred embodiment of the self-stabilizing gas lift valve constructed in accordance with the present invention.

FIG. 2 illustrates a sectional view of a first preferred embodiment of the gas lift valve apparatus 30.

A top 42 is removably secured to the apparatus 30. The apparatus 30 includes an elongated, tubular body 44.

The tubular body 44 and the top 42 form an elongated gas chamber 46 within the tubular body 44. At least one gas inlet port 48 through the tubular body permits passage of injected gas from the annulus into the elongated gas chamber 46.

In the present embodiment, a moveable impingement disk 50 is moveable within the elongated gas chamber 46. The impingement disk 50 is generally flat, circular and coaxial with the elongated gas chamber 46. The diameter of the disk 50 is slightly less than the inner diameter of the chamber 46.

Within the elongated gas chamber 46 between the disk 50 and the ports 48 is a nozzle 40 having a central opening.

Extending from the lower side or lower face of the impingement disk 50 is a conical plug 52 which is coaxial with the impingement disk 50. The largest diameter portion of the conical plug 52 is connected to the impingement disk 50 and tapers downward to a smaller diameter.

Extending axially from the conical plug 52 is a central shaft 54 which is connected to a valve plug 56. The valve plug 56 is semi-hemispherical in the preferred embodiment.

On the opposed side of the valve plug 56 is a valve closure force mechanism. In the first preferred embodiment shown in FIG. 2, the valve force closure mechanism is a first compression spring 58.

The compression spring 58 is surrounded by a cylindrical skirt 60. The cylindrical skirt 60 and compression spring 58 travel within a cylindrical recess 62 in a base 34 of the tubular body. A shaft 38 extending from the valve plug 56 travels within a bore 36 in the base 34.

One or more outlet passages 66 permit passage of pressurized gas from the elongated gas chamber 46 of the valve apparatus 30. The gas from the outlet passages 66 thereafter passes into the production tubing or tubing string 14 (not shown in FIG. 2).

A conical cup 22 is axially aligned within the tubular body 44. Extending from the conical cup 22 is a valve seat 68. The valve plug 56 is urged toward the valve seat 68 by the valve closure force mechanism.

When the gas pressure at the outlets 66 is greater than the pressure at the inlet or inlets 48, the valve plug 56 is urged upward by force of the compression spring 58 as well as by the pressure difference. The opening between the plug 56 and the valve seat 68 is thereby closed and flow from the tubing to annulus is prohibited.

Figure 3:
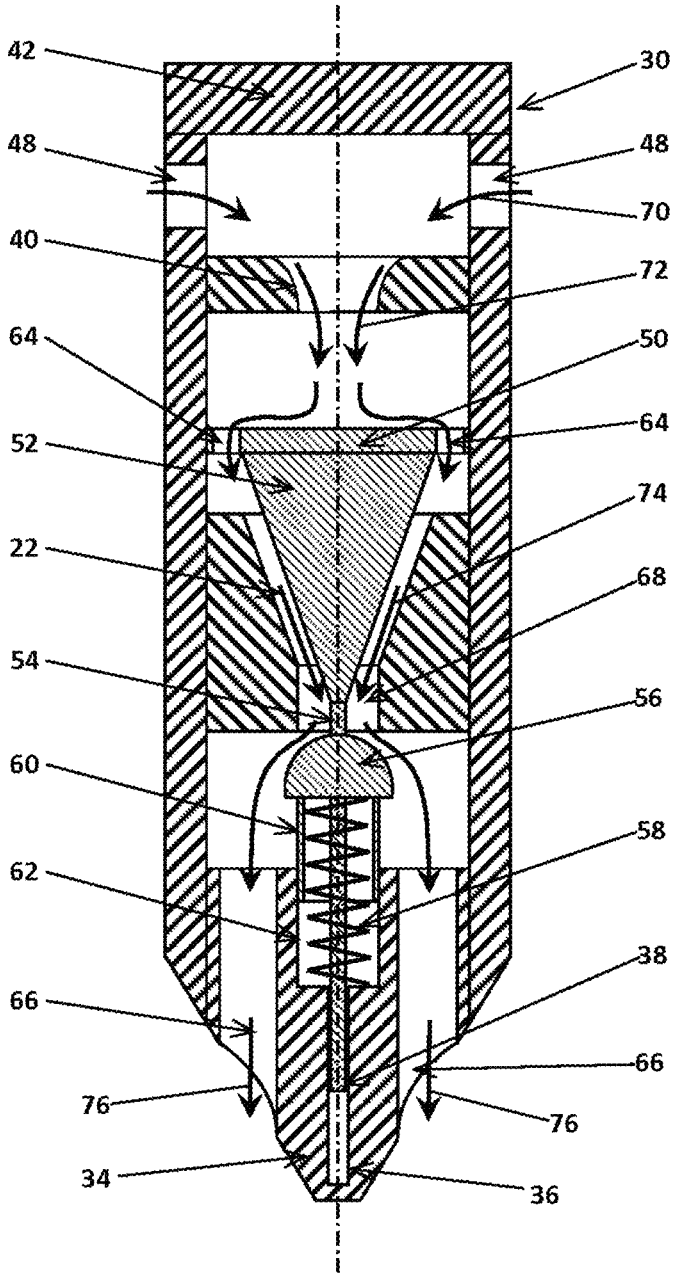
FIG. 3 illustrates a sectional view of the valve shown in FIG. 2 showing injected gas.

FIG. 3 illustrates the apparatus 30 upon introduction of pressurized gas into the inlets 48. Arrows 70 illustrate the path of pressurized gas through the inlets 48 and into the elongated chamber 46.

The pressurized gas is directed through the central opening of the nozzle 40 as seen by arrows 72. The pressurized gas is thereby directed toward the top of the impingement disk 50. Thereafter, the pressurized gas passes through a plurality of openings 64 in the impingement disk 50. The openings 64 are arranged in an annular pattern near the circumferential edge of the impingement disk 50. Thereafter, the pressurized gas passes through a space formed between the conical plug 52 and the conical cup 22 as shown by arrows 74.

The kinetic energy from the injected gas is converted to downward force on the impingement disk 50. The force of the pressurized gas on the impingement disk 50 forces the conical plug 52 and the valve plug 56 downward so that the valve plug 56 is moved away from the valve seat 68, providing an opening or passageway for gas through the outlets 66 as shown by arrows 76 and thereafter into the production tubing (not shown).

Figure 4:
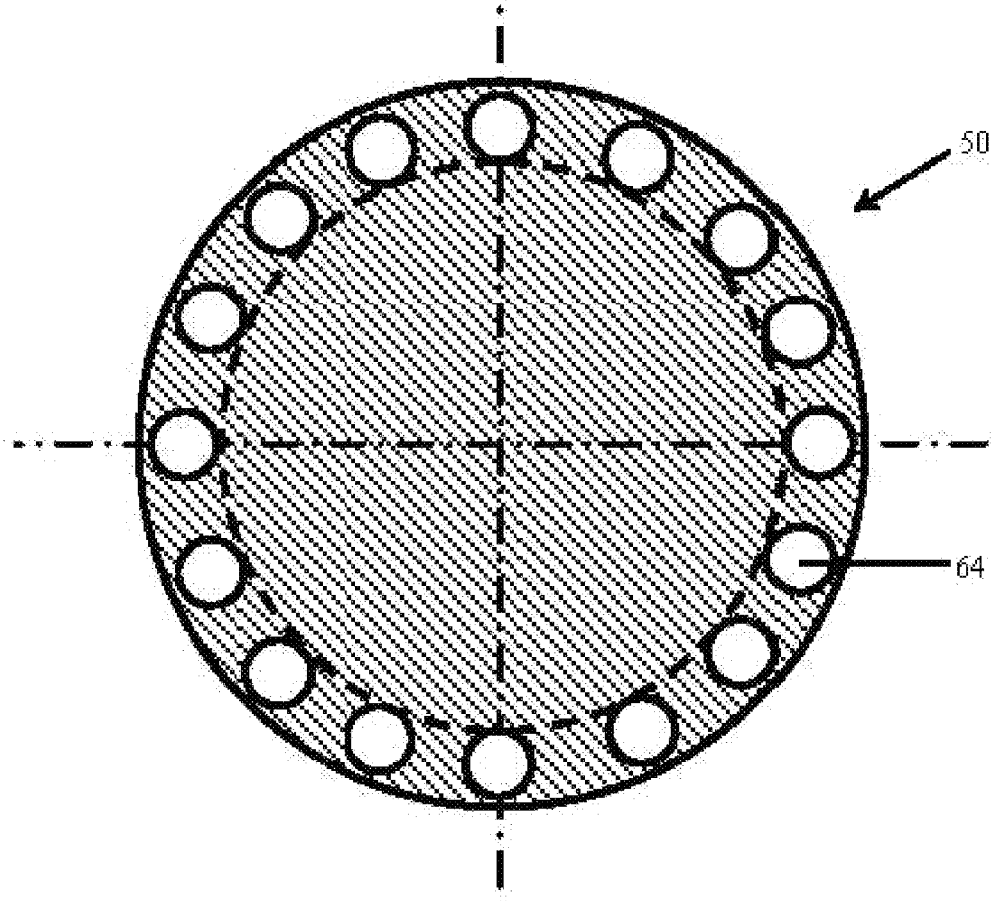
FIG. 4 illustrates a cross-sectional view of an impingement disk apart from the gas lift valve.

FIG. 4 illustrates a cross-sectional view of the impingement disk 50 apart from the gas lift apparatus 30. The annular pattern of the openings is visible FIGS. 5, 6 and 7 illustrate the operation of the self-regulating and self-stabilizing valve apparatus 30.

When tubing pressure becomes lower, the differential pressure between the pressure at the valve inlet 48 and outlet 66 increases and the gas injection flow rate increases. Higher differential pressure and flow rate exert greater force on the moving parts of the gas lift valve 30, and push the moving parts axially downward with more displacement which corresponds to spring compression. The force acted on the moving parts by the flow plus the weight of the moving parts should be equal to the force from the spring 58.

Figure 5:
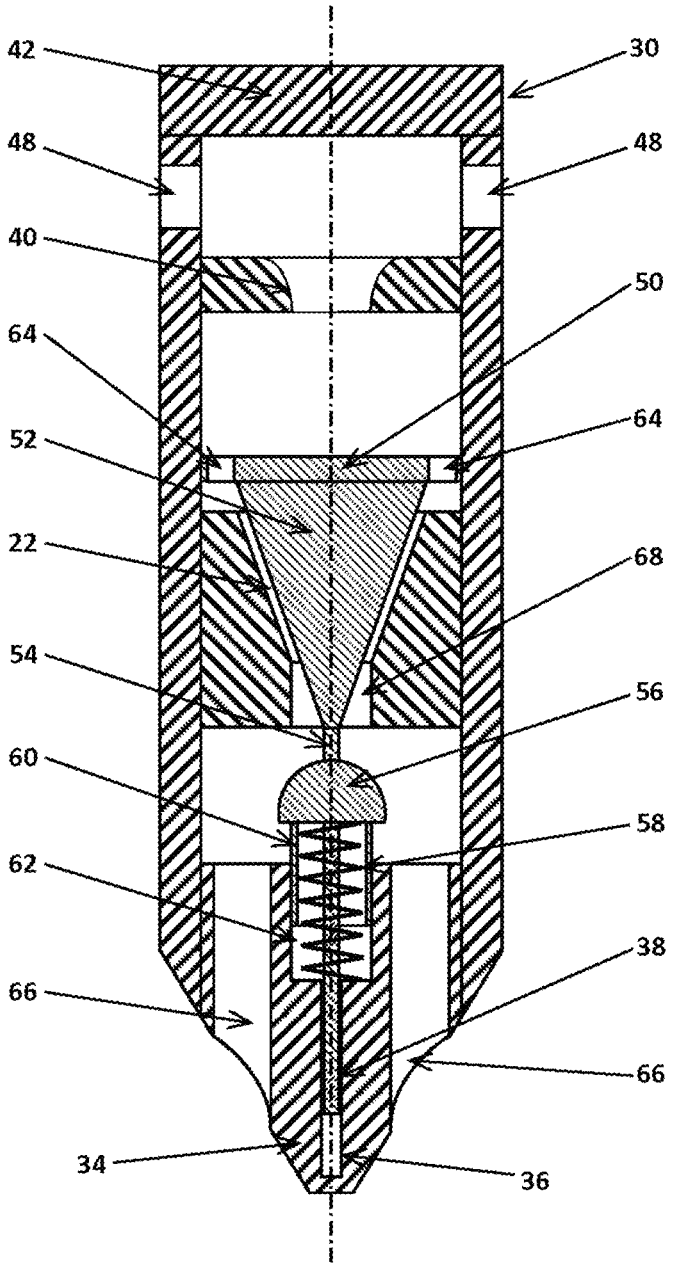
FIGS. 5 and 6 illustrate the operation of the self-stabilizing valve apparatus.

As shown in FIG. 5, when the gap between the cone plug 52 and the conical cup 22 becomes smaller, the gas flow is restricted.

Figure 6:
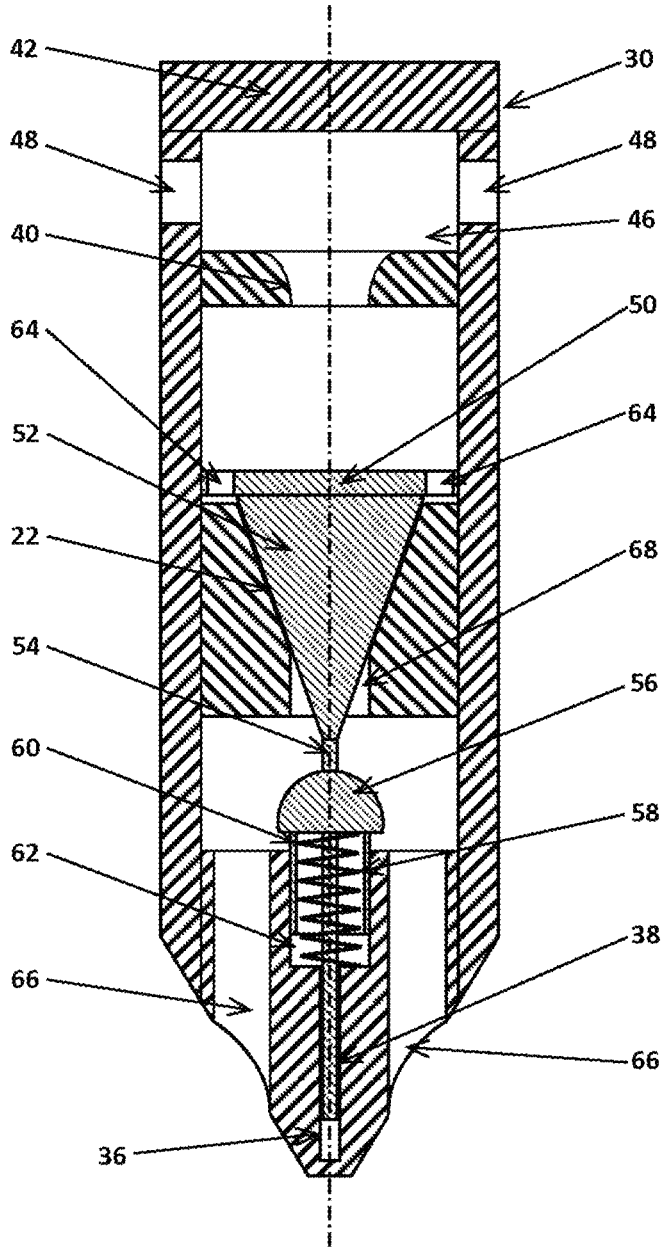
Figure 7:
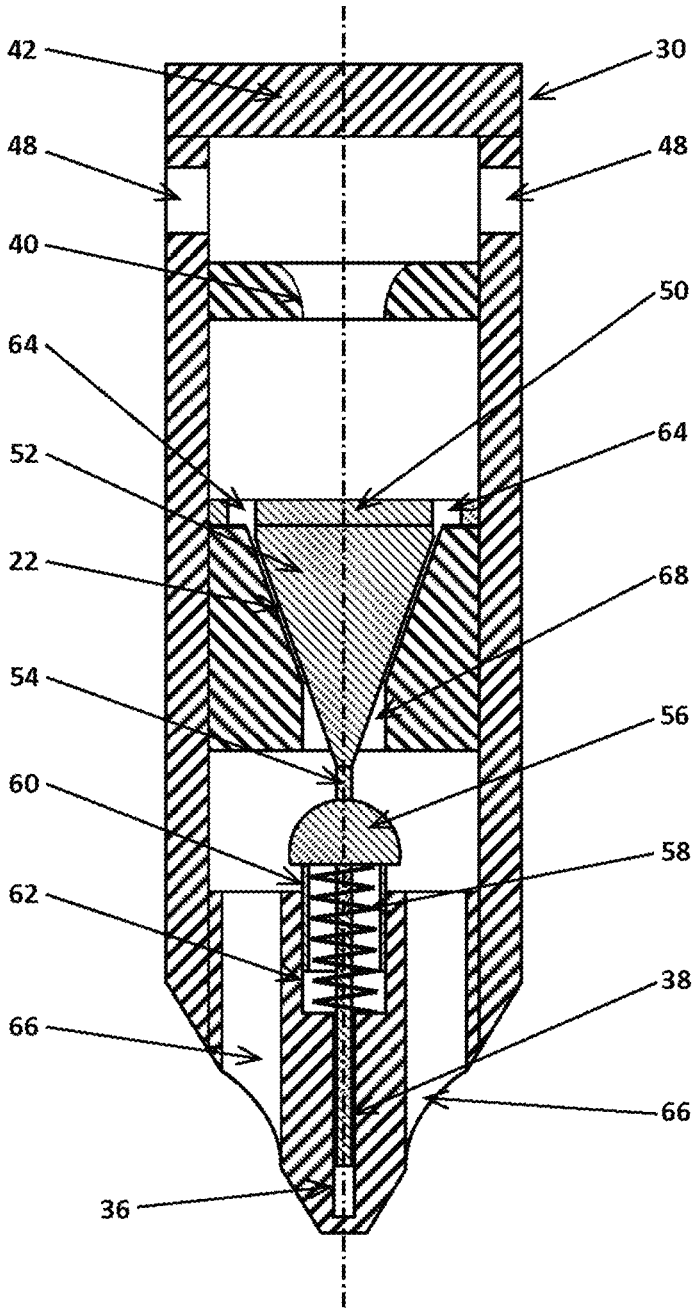
FIG. 7 illustrates a second preferred embodiment of the self-stabilizing gas lift valve.

With further increase of the pressure drop, the gap or flow channel between the cone plug 52 and the host cup 22 can be closed and the flow is stopped (as shown in FIG. 6). The differential pressure for the closing is equal to the net force (after deduction of the weight of the moving part) of the spring 58 at the closing position divided by the throat cross-sectional area of the seat 68.

After the gas injection is restricted or stopped, the pressure in the production tubing recovers due to the mixture density increase in the tubing above the injection point. Then, the pressure drop from the inlet 48 to the outlets 66 becomes smaller. The downward force on the moving parts becomes smaller and the valve opening becomes larger again. As a result, the gas injection is stabilized within a certain pressure drop range and the pressure inside the production tubing is also maintained based on the gas supply pressure and the production rate of the well.

Figure 8:
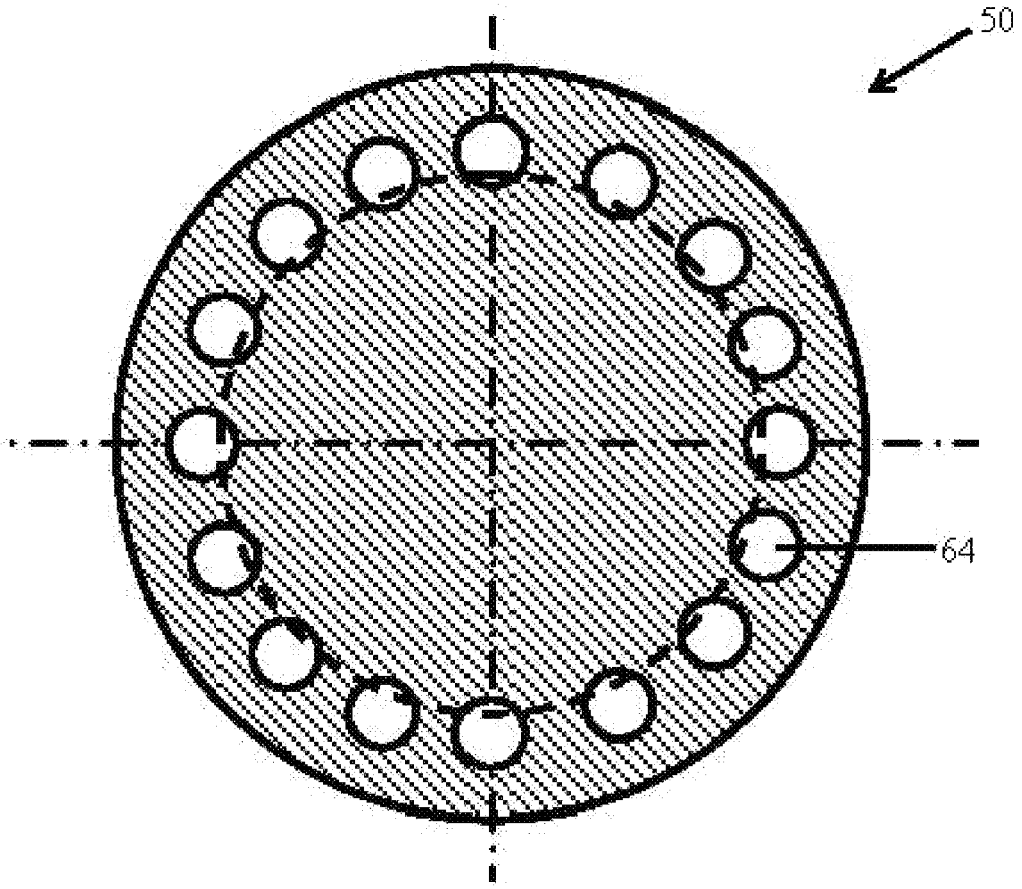
FIG. 8 illustrates a cross-sectional view of an alternate impingement disk for the valve shown in FIG. 7.

FIGS. 7 and 8 illustrate an alternate preferred embodiment. As shown in FIG. 7, the diameter of cone plug 52 can be made slightly smaller than the conical host cup 22. The ring holes on the impinging disk 50 are moved slightly toward the center of the disk 50. A sectional view of the disk is shown in FIG. 8. A small gap is kept or retained when the differential pressure force is higher than the net force of the spring 58. Gas is restricted but continuously flows through the small channel or gap between the cone plug 52 and the conical host cup 22.

The valve opening change with the pressure drop increase can also be altered with different designs.

Figure 9:
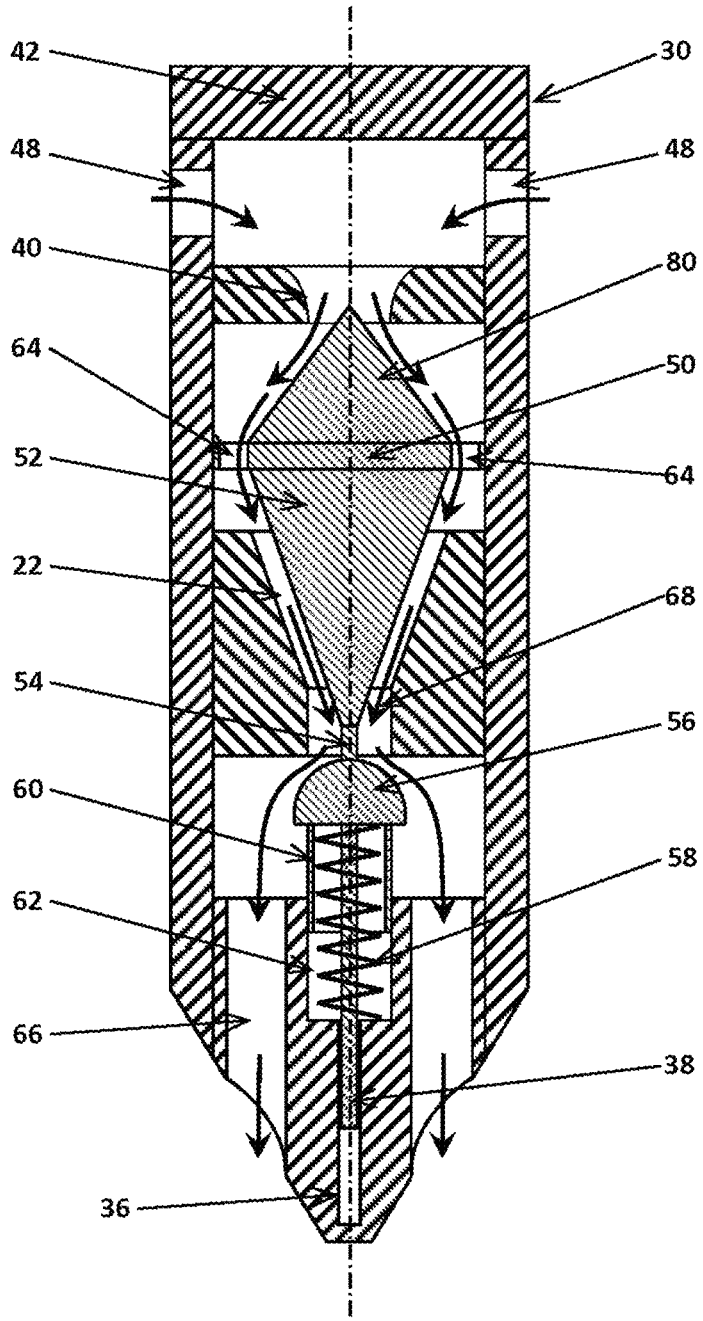
FIG. 9 illustrates a cross-sectional view of a third preferred embodiment of the present invention.

FIG. 9 illustrates a third preferred embodiment. A cone shaped nose 80 can be set on top of the impinging disk 50. The nose regulates the flow. With this streamline design, the pressure loss becomes smaller. The displacement of the moving parts depends more on frictional force than kinetic energy of the gas flow.

Figure 10:
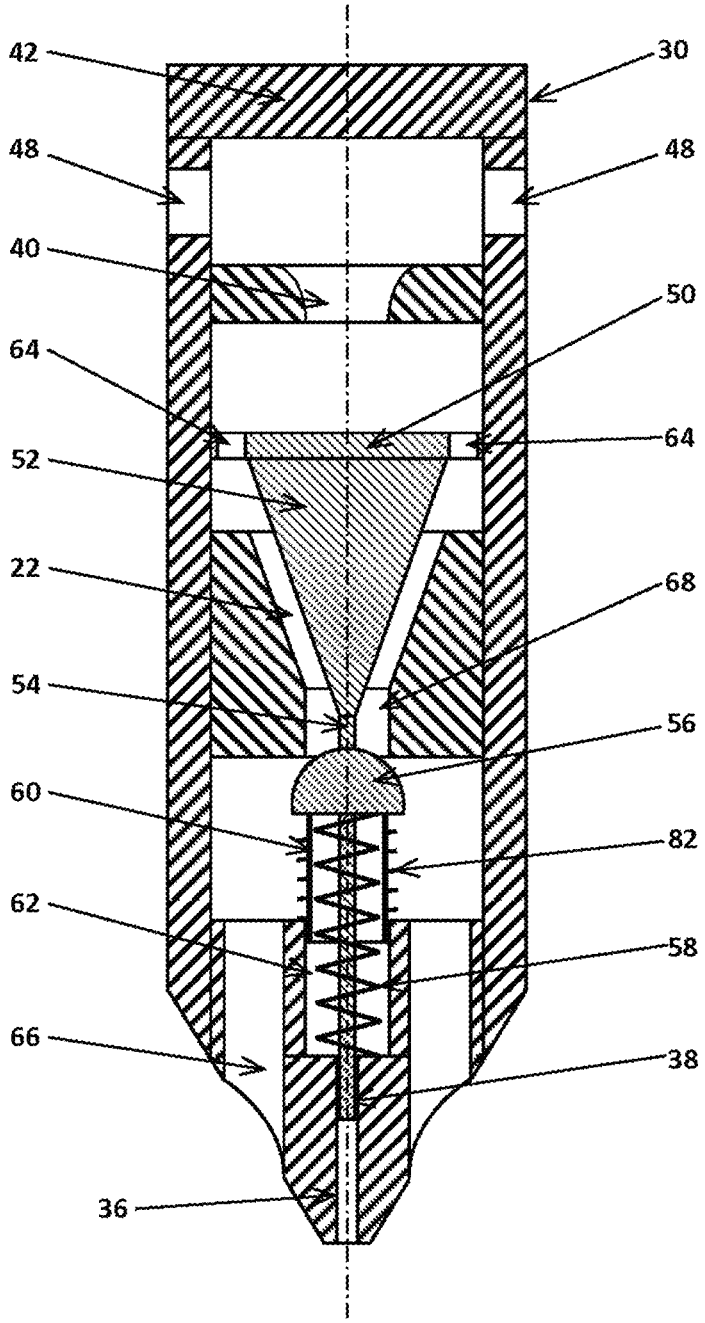
FIG. 10 illustrates a cross-sectional view of a fourth preferred embodiment of the present invention.

FIG. 10 illustrates a fourth alternate preferred embodiment. A second compression spring 82 is installed outside of the skirt 60. The spring 82 is retained between the valve plug and base. This spring 82 does not act until the valve plug is pushed down onto it. This may correspond to the largest valve opening. Then, further increase of the pressure drop is balanced by both springs. Accordingly, the valve performance curve is altered.

Figure 11:
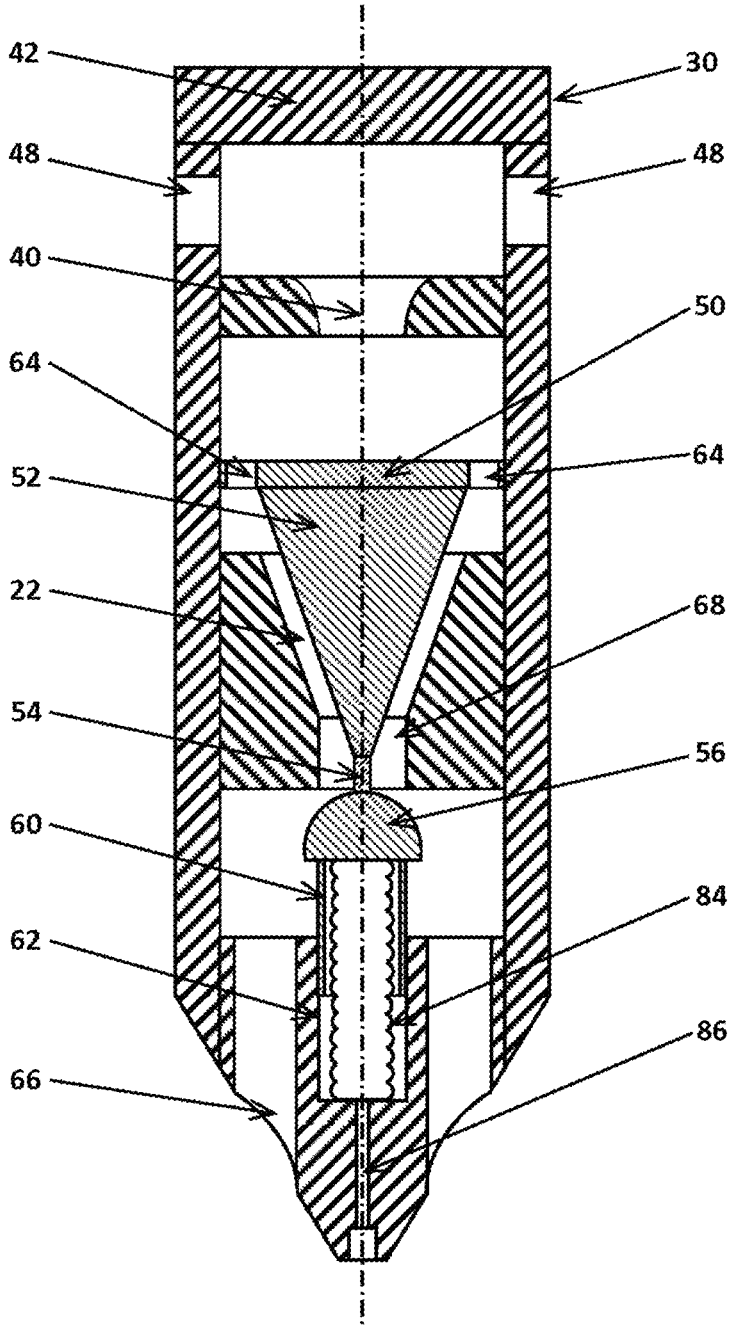
FIG. 11 illustrates a cross-sectional view of a fifth preferred embodiment of the present invention.

FIG. 11 illustrates a fifth preferred embodiment in which a metal bellows 84 can be used as an alternative for the spring. The metal bellows 84 can be filled with compressed nitrogen or any inert gas with a required pressure through a port 86.

Whereas, the present invention has been described in relation to the drawings attached hereto, it should be understood that other and further modifications, apart from those shown or suggested herein, may be made within the spirit and scope of this invention.

What is claimed is:

1. A process to stabilize gas lift for oil and gas production, which process comprises the steps of:

urging a valve plug toward a valve seat to a closed position through a valve closure force mechanism;

injecting gas through at least one gas inlet into an elongated gas chamber in a valve body to provide force on a generally flat portion of a moveable impingement disk in said elongated gas chamber in order to overcome said valve closure force mechanism wherein said impingement disk includes a plurality of openings therethrough arranged in an annular pattern radially spaced from a center of said impingement disk; and urging a conical plug extending from said impingement disk toward a conical cup so that when gas injected exceeds a predetermined force, said impingement disk is moved and a conical space between said conical plug and said conical cup is reduced.

2. A process to stabilize gas lift for oil and gas production as set forth in claim 1 including the additional step of directing injected gas from said gas inlet through a nozzle onto said impingement disk.

3. A process to stabilize gas lift for oil and gas production as set forth in claim 1 wherein said valve closure force mechanism includes a first compression spring.

4. A process to stabilize gas lift for oil and gas production as set forth in claim 1 wherein said valve closure force mechanism includes a gas filled bellows.

5. A self-stabilizing gas lift valve apparatus for oil and gas production, the apparatus comprising:

a valve body having at least one gas inlet in communication with an elongated gas chamber in said valve body;

a moveable impingement disk in said elongated gas chamber, wherein said impingement disk includes a plurality of openings therethrough arranged in an annular pattern radially spaced from a center of said impingement disk;

a conical plug extending from said impingement disk, said conical plug having a valve plug extending axially therefrom;

a conical cup terminating in a valve seat wherein said conical cup receives said conical plug therein;

a valve closure force mechanism urging said valve plug toward said valve seat;

wherein when gas injected through said at least one gas inlet provides a force upon said impingement disk overcoming the force of said valve closure force mechanism, said valve plug is opened and when said gas injected exceeds a predetermined force, said impingement disk is moved and a conical space between said conical plug and said conical cup is reduced.

6. A self-stabilizing gas lift valve apparatus as set forth in claim 5 wherein said valve closure force mechanism is a first compression spring.

7. A self-stabilizing gas lift valve apparatus as set forth in claim 6 wherein said first compression spring is retained within a cylindrical skirt.

8. A self-stabilizing gas lift valve apparatus as set forth in claim 7 wherein said valve closure force mechanism includes a second spring surrounding said cylindrical skirt.

9. A self-stabilizing gas lift valve apparatus as set forth in claim 5 wherein said valve closure force mechanism is a gas filled bellows.

10. A self-stabilizing gas lift valve apparatus as set forth in claim 5 including a nozzle within said elongated gas chamber between said gas inlet and said impingement disk to direct said gas injected onto said impingement disk.

11. A self-stabilizing gas lift valve apparatus as set forth in claim 5 wherein said elongated gas chamber is tubular and wherein said tubular gas chamber is coaxial with said impingement disk.

12. A self-stabilizing gas lift valve apparatus as set forth in claim 5 wherein said valve plug is semi-spherical.

13. A self-stabilizing gas lift valve apparatus for oil and gas production, the apparatus comprising:

a valve body having at least one gas inlet in communication with an elongated gas chamber in said valve body;

a moveable impingement disk in said elongated gas chamber including a cone shaped nose projecting from said movable impingement disk;

a conical plug extending from said impingement disk, said conical plug having a valve plug extending axially therefrom;

a conical cup terminating in a valve seat wherein said conical cup receives said conical plug therein;

a valve closure force mechanism urging said valve plug toward said valve seat;

wherein when gas injected through said at least one gas inlet provides a force upon said impingement disk overcoming the force of said valve closure force mechanism, said valve plug is opened and when said gas injected exceeds a predetermined force, said impingement disk is moved and a conical space between said conical plug and said conical cup is reduced.

14. A process to stabilize gas lift for oil and gas production, which process comprises the steps of:

urging a valve plug toward a valve seat to a closed position through a valve closure force mechanism;

injecting gas through at least one gas inlet into an elongated gas chamber in a valve body to provide force on a generally flat portion of a moveable impingement disk in said elongated gas chamber in order to overcome said valve closure force mechanism, including a cone shaped nose projected from said moveable disk; and urging a conical plug extending from said impingement disk toward a conical cup so that when gas injected exceeds a predetermined force, said impingement disk is moved and a conical space between said conical plug and said conical cup is reduced.

* * * * *